US009896853B2

(12) United States Patent
Judd

(10) Patent No.: US 9,896,853 B2
(45) **Date of Patent: *Feb. 20, 2018**

(54) POPCORN CEILING PATCH

(71) Applicant: Jennifer Judd, East Hampton, CT (US)

(72) Inventor: Jennifer Judd, East Hampton, CT (US)

(73) Assignee: Jennifer Judd, East Hampton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/478,440

(22) Filed: Apr. 4, 2017

(65) Prior Publication Data

US 2017/0204626 A1 Jul. 20, 2017

Related U.S. Application Data

(62) Division of application No. 14/449,681, filed on Aug. 1, 2014, now Pat. No. 9,624,664.

(60) Provisional application No. 61/928,248, filed on Jan. 16, 2014.

(51) Int. Cl.

| | |
|---|---|
| ***E04B 1/00*** | (2006.01) |
| ***E04G 23/02*** | (2006.01) |
| *E04B 9/00* | (2006.01) |
| *E04B 1/99* | (2006.01) |
| *E04F 15/02* | (2006.01) |
| *E04F 15/20* | (2006.01) |

(52) U.S. Cl.

CPC ..... *E04G 23/0214* (2013.01); *E04G 23/0296* (2013.01); *E04B 1/994* (2013.01); *E04B 9/00* (2013.01); *E04B 9/001* (2013.01); *E04F 15/0215* (2013.01); *E04F 15/02155* (2013.01); *E04F 15/203* (2013.01)

(58) Field of Classification Search

CPC . E04B 9/00; E04B 9/001; E04B 1/994; E04G 23/0296; E04F 15/0215; E04F 15/02155; E04F 15/203

USPC ..... 52/746.1, 741.4, 741.41, 741.1, 514, 52/403.1; 156/94; 428/63; 181/284; 427/258, 402

See application file for complete search history.

(56) References Cited

U.S. PATENT DOCUMENTS

| | | | | |
|---|---|---|---|---|
| 4,135,017 | A * | 1/1979 | Hoffmann, Sr. | B29C 73/00 156/94 |
| 5,820,958 | A * | 10/1998 | Swallow | C09J 7/0246 428/194 |
| 7,971,405 | B2 * | 7/2011 | Hansen | E04F 13/04 156/94 |
| 8,021,505 | B2 * | 9/2011 | Lewis | E04G 23/0203 156/71 |
| 8,381,474 | B2 * | 2/2013 | Lewis | E04G 23/0203 52/514 |
| 9,624,664 | B2 * | 4/2017 | Judd | E04B 9/001 |
| 2006/0059829 | A1 * | 3/2006 | Flynn | E04G 23/0203 52/514 |
| 2012/0031033 | A1 * | 2/2012 | Lewis | E04G 23/0203 52/514 |
| 2014/0295125 | A1 * | 10/2014 | Arikawa | B64C 3/26 428/63 |
| 2016/0009055 | A1 * | 1/2016 | Spadaro | B32B 7/06 428/41.8 |

(Continued)

*Primary Examiner* — Chi Q Nguyen

(74) *Attorney, Agent, or Firm* — McCormick, Paulding & Huber LLP

(57) ABSTRACT

A popcorn patch article has a flexible substrate with a sticky surface and a facing surface opposite the sticky surface, and an acoustic texture captured on the facing surface of the substrate.

11 Claims, 2 Drawing Sheets

(56) References Cited

U.S. PATENT DOCUMENTS

2016/0121585 A1* 5/2016 Jennings ..... C08J 5/121
156/94

* cited by examiner

POPCORN CEILING PATCH

CROSS REFERENCE TO RELATED APPLICATIONS

This application is a divisional of application Ser. No. 14/449,681, filed Aug. 1, 2014 now U.S. Pat. No. 9,624,664, which claims the benefit under 35 USC § 119(e) of U.S. Application No. 61/928,248 "Popcorn Ceiling Patch," filed on Jan. 16, 2014, each of which is hereby incorporated by reference herein in their entirety.

BACKGROUND

Technical Field

Embodiments of the invention relate to home repairs, more particularly, to repair of ceilings.

Discussion of Related Art

Many homes are built with ceilings made either of gypsum board, covered with a thin layer of "mud" (plaster) or entirely of plaster over lath. Often, gypsum board ceilings have been finished with an acoustic texture material commonly known as "popcorn." This type of ceiling was particularly popular during the 1980s and has continued to be used in new construction.

Although any sort of ceiling can suffer damage from a variety of causes (bumps and scratches by moving objects, water leaks, and so forth), popcorn ceilings can be particularly challenging to repair. Even if the damaged structure (gypsum board and plaster) can merely be patched instead of being completely replaced, the acoustic texture material must be repaired in a way that matches to surrounding surface. Professionals in the field agree that achieving a visual match of popcorn texture is a time consuming and highly frustrating endeavor.

Current methods for fixing a popcorn ceiling include: removal of all popcorn on entire ceiling where the damage is (messy, costly, time consuming); spraying popcorn texture from a can onto the damaged area (e.g., as disclosed by U.S. Pub. 2013/0112340); rolling/brushing paint and popcorn texture onto the damaged area; or spraying paint and popcorn texture from a popcorn sprayer apparatus onto the damaged area.

Spraying of popcorn requires blocking off the spray area with sheets of plastic by dropping the plastic from the ceiling to floor (held by tape or tacks), as well as on the floor underneath. Over spray is significant and will get on the surrounding areas if not properly blocked. Despite best efforts of skilled workers, sprayed texture seldom exactly matches the existing surrounding popcorn texture, so that home owners seldom are pleased with the results. Similarly, brushed or rolled texture also very seldom matches extant texture to the point of satisfaction.

A more exotic technique for matching popcorn texture is to mold and cast an exact copy of adjacent popcorn texture (e.g., as disclosed by U.S. Pat. No. 8,349,110).

BRIEF DESCRIPTION

According to embodiments of the invention, a popcorn patch article has a flexible substrate with a sticky surface and a facing surface opposite the sticky surface, and an acoustic texture captured on the facing surface of the substrate.

According to aspects of the invention, a popcorn patch article is made by applying an acoustic texture to a facing surface of a flexible substrate having a sticky surface opposite the facing surface; and applying a cover coating over the acoustic texture.

According to aspects of the invention, a damaged acoustic ceiling is repaired by removing a backing paper from a sticky surface of a flexible substrate that has an acoustic texture captured on a surface opposite the sticky surface, and applying the sticky surface of the flexible substrate to the acoustic ceiling to cover the damaged area with the acoustic texture facing downward

DRAWINGS

DETAILED DESCRIPTION

A popcorn or acoustic ceiling patch ("Popcorn Patch"), according to an embodiment of the invention, is a patch that has a simulated popcorn texture with a 'peel and stick' backing. It is a flexible and paintable texture that is easily applied to the damaged area of the ceiling. It is available in at least three different popcorn textures ranging from small popcorn texture to large. It is available in various sizes to accommodate damaged areas from small to large, for example:

a) 4"×4" Patch
b) 6"×6" Patch
c) 6"×6' Roll.

The large roll can be cut to size and used for many sized areas such as narrow, long strips along the ceiling where the wall and ceiling meet, or larger damaged ceiling areas than what the smaller Popcorn Patches would be used for. The large roll can be used in its entirety, similar to wallpaper, in order to cover large rectangular ceiling areas. Indeed, the large roll might be used for original installation of popcorn ceiling in new construction.

Figure 1:
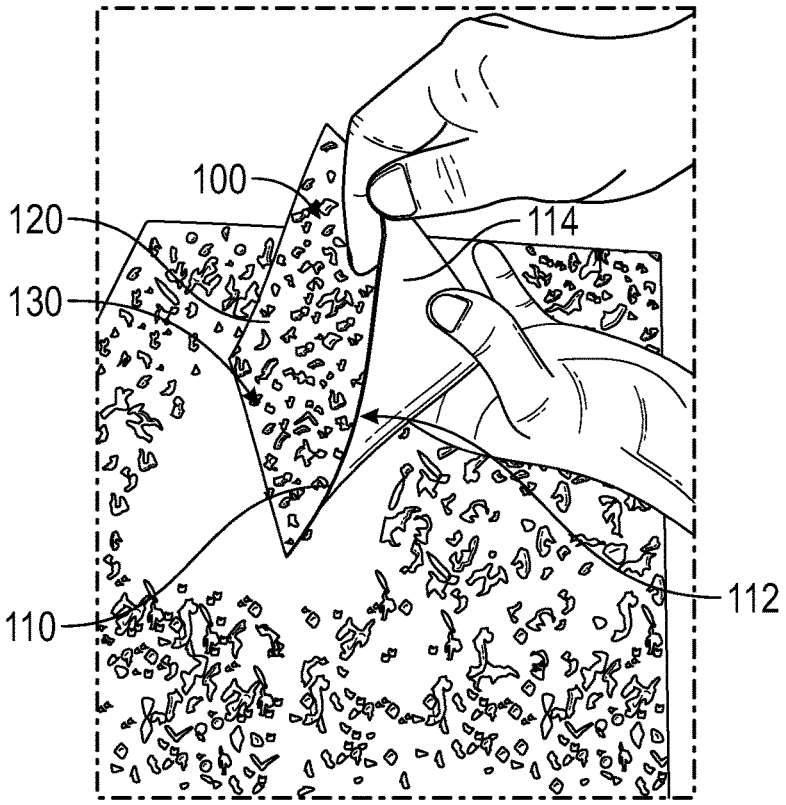
FIG. 1 shows a popcorn patch article according to a first embodiment of the invention.

In an exemplary embodiment, the following materials are used to make a popcorn patch article 100 that has a pre-sprayed popcorn texture, as shown in FIG. 1:

Flexible substrate 110 with a sticky surface 112 and a backing layer 114, e.g., "Controltac Graphic Marketing System" brand label material as manufactured by 3M, or any sticky-backed cellulose, cloth, polymer, or metal substrate having structural properties suitable for use in the forms above described. Although the "Controltac" brand label material has an adhesive applied as its sticky surface, sticky surfaces equally may be mechanically formed—e.g., as microfibers, similar to the hairs of a gecko's foot; or as hooked fibers, similar to those of hook-and-loop fasteners; or as spines or prickles, with or without barbs, e.g., similar to those of thistles or cacti.

Popcorn texture 120 (e.g., Homax brand, Zinnser brand, or any other popcorn texture available in stores or equivalent substance), which is sprayed onto a facing surface 116 of the flexible substrate 110. Although the exemplary "Controltac Graphic Marketing System" has a non-sticky facing surface and is convenient to handle, it may be equally acceptable to use a substrate 110 that has two sticky surfaces, e.g., in the nature of double-sided tape.

Flexible cover coating 130 (e.g., Rust-oleum brand Leak-Seal Flexible Rubber Coating, or any similar flexible and water-resistant coating), which is applied over the popcorn texture 120 to make it pliable for installation and also to ensure that the popcorn texture will not crumble/flake off during storage and/or shipping or after installation. In case the flexible substrate 110 might have two sticky surfaces, it will be particularly desirable to ensure that the popcorn texture 120, and/or the flexible cover coating 130, completely cover the sticky surface that otherwise might be exposed to accumulate dust as installed. Additionally, it may be desirable to apply the acoustic texture to leave portions of the facing surface exposed, and to apply the flexible cover coating to cover both the acoustic texture and the exposed portions of the facing surface, thereby capturing the acoustic texture to the facing surface. In case the acoustic ceiling has been water-damaged, better results may be obtained by priming the scraped ceiling prior to installation.

Figure 2:
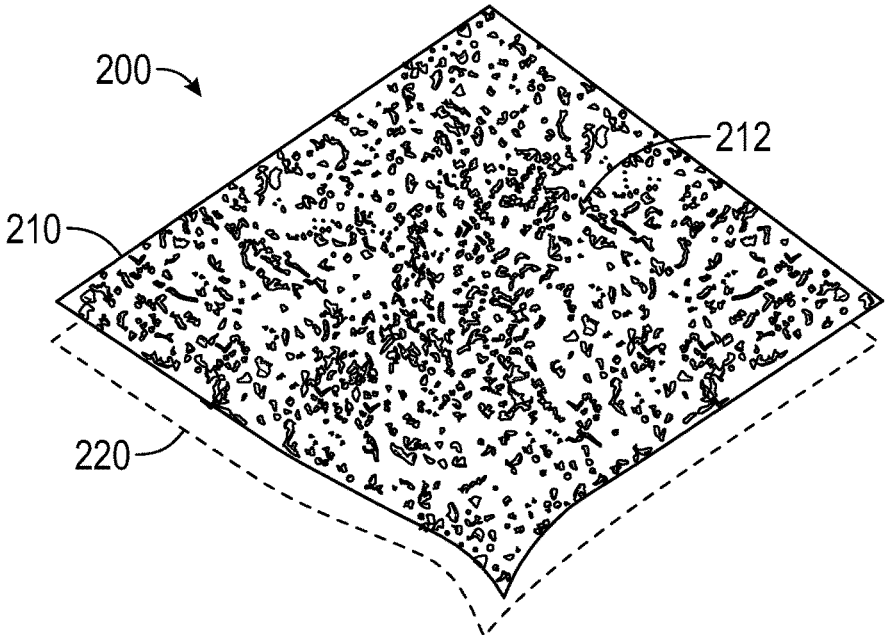
FIG. 2 shows a popcorn patch article according to a second embodiment of the invention.

According to other embodiments of the invention, as shown in FIG. 2, a popcorn patch article 200 with integrally molded popcorn texture may be formed (e.g. by injection molding, blow molding, or the like process) as a single molded polymer sheet 210 having an adhesive layer 220. In such embodiments, a popcorn texture 212 is integrally formed in the polymer sheet 210, while a backing layer 114 is provided as for the popcorn patch article 100.

Figure 3:
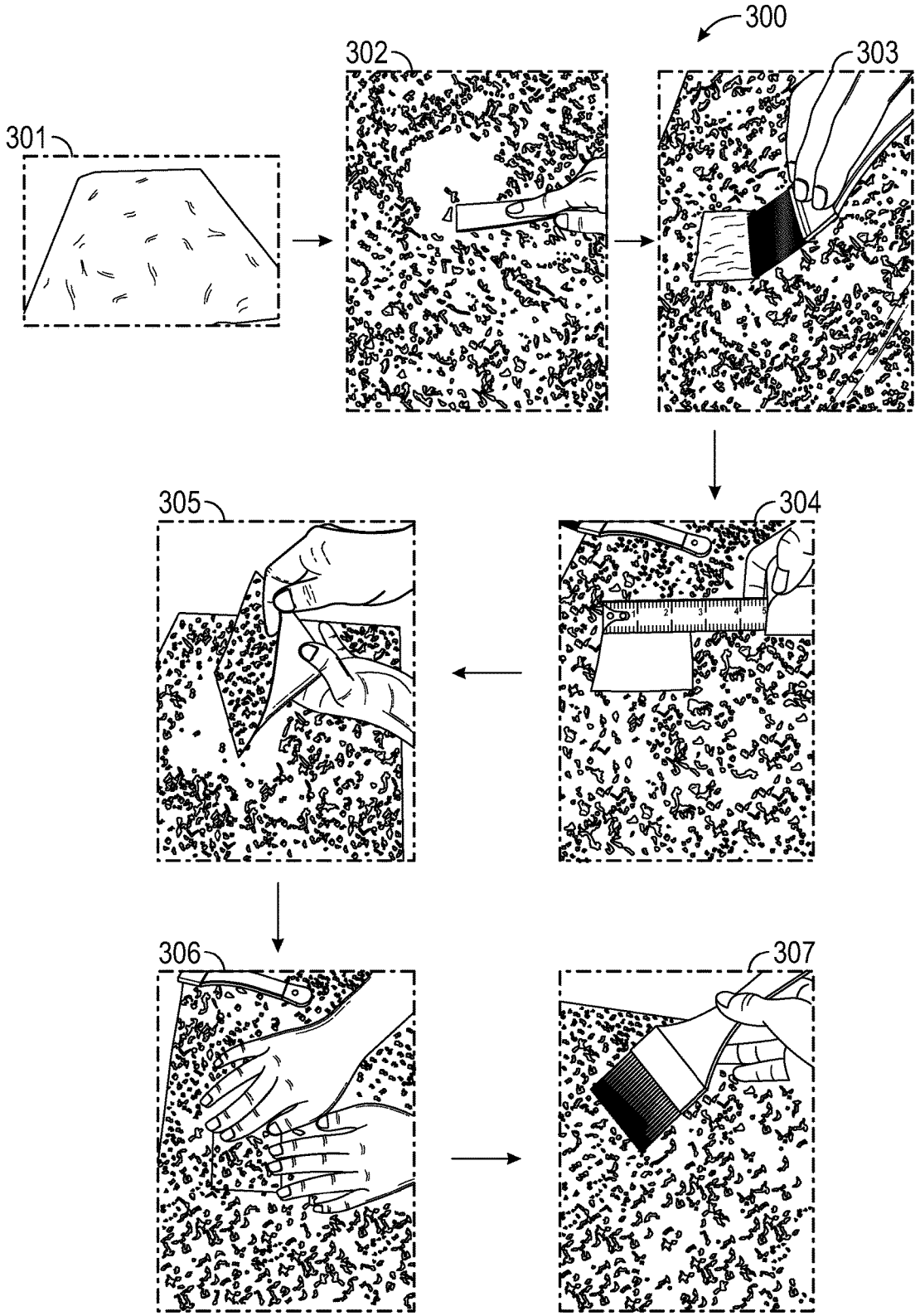
FIG. 3 shows steps of a method for repairing a damaged acoustic ceiling, using a popcorn patch article according to the invention.

According to an aspect of the invention, the Popcorn Patch may be applied by a method 300 that comprises the following steps (as shown in FIG. 3):

301. Lay a drop cloth and/or plastic on the floor beneath the damaged area.

302. Remove the damaged popcorn by scraping (e.g., with a putty knife).

303. Optionally, brush away remaining debris.

304. Measure the diameter of the damaged area.

305. Peel backing paper off of the Popcorn Patch

306. Apply sticky side of the Popcorn Patch to the ceiling

307. Paint over flexible popcorn texture coating.

Thus, in embodiments, either the damaged acoustic texture may be removed to fit the size of the available popcorn patch article; or the popcorn patch may be cut to the size of the area with removed acoustic texture. Optionally, small amounts of brush-on popcorn texture can be added to cover edges of the Popcorn Patch. Optionally, edges of the Popcorn Patch may be cut to irregular shape so as to obscure the seam between the Popcorn Patch and the original ceiling texture.

Although exemplary embodiments of the invention have been described with reference to attached drawings, those skilled in the art will apprehend various changes in form and detail consistent with the scope of the invention as defined by the appended claims.

What is claimed is:

1. A method for repairing a damaged area of an acoustic ceiling having a preexisting acoustic texture, said method comprising:

providing a flexible substrate having a first surface and an opposing second surface, wherein the first surface includes a sticky substance covered by a backing paper and the opposing second surface has an acoustic texture captured thereon;

removing the backing paper from the first surface of the flexible substrate;

applying the flexible substrate to the acoustic ceiling to cover the damaged area with the sticky substance contacting the acoustic ceiling and the acoustic texture facing away therefrom;

identifying the damaged area;

removing acoustic texture from the acoustic ceiling surrounding the damaged area to define a repair area, before applying the flexible substrate to the acoustic ceiling;

scraping the acoustic ceiling to remove acoustic texture within the repair area; and priming the scraped ceiling prior to the step of applying the flexible substrate to the acoustic ceiling.

2. The method as claimed in claim 1, wherein the repair area matches a size of the flexible substrate.

3. The method as claimed in claim 2, further comprising a step of painting over the acoustic texture of the flexible substrate after the substrate has been applied to the acoustic ceiling.

4. The method as claimed in claim 1, wherein the flexible substrate can be cut to size to fit a size of the damaged area.

5. A method for repairing a damaged area of an acoustic ceiling having a preexisting acoustic texture, said method comprising:

providing a flexible substrate having a first surface and an opposing second surface, wherein the first surface includes a sticky substance covered by a backing paper and the opposing second surface has an acoustic texture captured thereon;

removing the backing paper from the first surface of the flexible substrate;

applying the flexible substrate to the acoustic ceiling to cover the damaged area with the sticky substance contacting the acoustic ceiling and the acoustic texture facing away therefrom; and applying brush-on acoustic texture to the edges of the flexible substrate.

6. A method for installing an acoustic ceiling, comprising:

providing a roll comprising:

a flexible substrate having a sticky surface and a facing surface opposite the sticky surface;

an acoustic texture applied to the facing surface of the substrate;

a flexible cover coating applied over the combined acoustic texture and flexible substrate for capturing the acoustic texture on the facing surface of the substrate; and applying the roll to a ceiling by rolling the sticky surface of the flexible substrate onto the ceiling; and applying brush-on acoustic texture to the edges of the flexible substrate.

7. The method of claim 6 wherein the step of rolling the sticky surface of the flexible substrate on the ceiling is performed with a wallpaper roller.

8. The method of claim 6 wherein the acoustic texture is pre-sprayed onto the facing surface of the substrate.

9. The method of claim 6, further comprising a step of cutting edges of the flexible substrate to a jagged shape to obscure a seam created during the step of rolling the sticky surface of the flexible substrate on the ceiling between the flexible substrate and the ceiling.

10. The method of claim 6, further comprising a step of painting over the acoustic texture of the flexible substrate after the substrate has been applied to the acoustic ceiling.

11. A method for installing an acoustic ceiling, comprising:

providing a roll comprising:

a flexible substrate having a sticky surface and a facing surface opposite the sticky surface;

an acoustic texture applied to the facing surface of the substrate;

a flexible cover coating applied over the combined acoustic texture and flexible substrate for capturing the acoustic texture on the facing surface of the substrate; and applying the roll to a ceiling by rolling the sticky surface of the flexible substrate onto the ceiling;

identifying a damaged area and removing acoustic texture from the acoustic ceiling surrounding the damaged area to define a repair area, before applying the flexible substrate to the acoustic ceiling;

scraping the acoustic ceiling to remove acoustic texture within the repair area; and priming the scraped ceiling prior to the step of applying the flexible substrate to the acoustic ceiling.

* * * * *